US010292510B1

(12) United States Patent
Tefft-Feldman

(10) Patent No.: US 10,292,510 B1
(45) Date of Patent: May 21, 2019

(54) PLACE SETTING OVERLAY FOR A TABLE

(71) Applicant: Natalie Tefft-Feldman, Palm Harbor, FL (US)

(72) Inventor: Natalie Tefft-Feldman, Palm Harbor, FL (US)

( * ) Notice: Subject to any disclaimer, the term of this patent is extended or adjusted under 35 U.S.C. 154(b) by 0 days.

(21) Appl. No.: 15/934,964

(22) Filed: Mar. 24, 2018

Related U.S. Application Data

(60) Provisional application No. 62/476,376, filed on Mar. 24, 2017.

(51) Int. Cl.
*A47G 11/00* (2006.01)
*A47G 23/03* (2006.01)
*A47G 21/16* (2006.01)

(52) U.S. Cl.
CPC ..... *A47G 11/006* (2013.01); *A47G 23/0303* (2013.01); *A47G 21/167* (2013.01)

(58) Field of Classification Search
CPC ..... A47G 11/006; A47G 23/0303; A47G 23/0306; A47C 31/10
USPC ..... 108/90; 150/158
See application file for complete search history.

(56) References Cited

U.S. PATENT DOCUMENTS 54,390 A 5/1866 Munson
177,876 A 5/1876 Nichols
708,109 A 9/1902 Williams
742,346 A 10/1903 McNeil
D934,993 9/1909 Brunson
1,066,256 A 7/1913 Curran
1,142,571 A 6/1915 Hoffberg
1,219,790 A 3/1917 Taylor
1,240,208 A 9/1917 Holtmeyer
1,241,968 A 10/1917 Hansen
1,261,314 A 4/1918 Stoddard
1,287,597 A 12/1918 Murray
1,332,776 A 3/1920 Sultanaki
1,464,889 A * 8/1923 Stirn ..... A47B 31/02 108/50.13
1,587,687 A 6/1926 Lichtman
1,684,173 A 9/1928 Diamond et al.
1,719,364 A 7/1929 Gilkey
1,817,404 A 8/1931 Whaley
1,865,459 A 7/1932 Edmands
1,926,429 A 9/1933 Bendalari
1,952,775 A * 3/1934 Quinlan ..... A47B 13/086 108/90

(Continued)

*Primary Examiner* — Jose V Chen
(74) *Attorney, Agent, or Firm* — Quickpatents, LLC; Kevin Prince

(57) ABSTRACT

An overlay system for a table having a center area includes a plurality of elongated arms each having a distal end and a proximal end. A connector is fixed proximate the proximal end of each arm and adapted to connect to the connector of an adjacent arm. With the arms each mutually connected at their proximal ends, and the proximal ends positions proximate the center area of the table, a regular geometric shape is formed in the center area of the table and the arms extend mutually equidistantly about the table to define a seating area for a place setting and a guest. Some embodiments of the invention include a central section that has a plurality of the connectors to which the arms are connected. Alternately, the arms may be integrally formed with the central section such that the overlay system is effectively a single piece of flexible material.

25 Claims, 8 Drawing Sheets

(56) References Cited

U.S. PATENT DOCUMENTS 2,057,551 A 10/1936 Bishop
2,151,381 A 3/1939 Goldsmith
2,381,580 A 8/1945 Einbinder
2,486,320 A 10/1949 Ost
2,586,153 A 2/1952 Eisman
2,727,253 A 12/1955 Tomsic
2,809,466 A 10/1957 Glover
3,185,197 A 5/1965 Spiro et al.
3,295,577 A 1/1967 Danielson
3,310,091 A * 3/1967 Geisen ..... A47G 11/004 108/90
3,368,601 A 2/1968 Gantert-Merz
3,372,404 A 3/1968 Getchell et al.
3,431,958 A 3/1969 Justice
3,785,419 A 1/1974 Sherlock
3,825,050 A 7/1974 Glover
3,939,976 A 2/1976 Vanlseghem, Jr.
3,960,193 A 6/1976 Davis
3,998,221 A 12/1976 Collins
4,393,104 A 7/1983 Fink
4,484,529 A * 11/1984 Caldares ..... A47G 11/003 108/161
4,627,363 A 12/1986 Jones
4,705,084 A 11/1987 Rodebaugh et al.
4,708,183 A 11/1987 Figueroa
4,739,580 A * 4/1988 Simmons ..... A47B 3/0818 47/17
4,750,402 A * 6/1988 Markey ..... G10G 7/005 108/90
4,777,992 A 10/1988 Olger
4,905,611 A 3/1990 Jung-Chung
4,991,242 A * 2/1991 Brown ..... A47G 9/0238 108/90
5,084,321 A 1/1992 Sui
5,240,758 A 8/1993 Honigberg
5,284,099 A 2/1994 Cohen
5,287,614 A 2/1994 Ehrlich
5,339,748 A 8/1994 Bilotti
5,449,539 A 9/1995 Stepanek
5,506,019 A 4/1996 Abeyta et al.
5,712,012 A 1/1998 Forman et al.
5,778,802 A 7/1998 Hairston et al.
5,908,681 A 6/1999 Foster
6,116,167 A 9/2000 Rabe
6,334,399 B1 1/2002 Kelldorf
6,381,812 B1 5/2002 Crider et al.
6,431,089 B1 * 8/2002 O'Brien ..... A47G 11/006 108/90
6,457,423 B1 10/2002 Gordon
6,589,491 B1 * 7/2003 Peddicord ..... C02F 1/42 108/90
6,591,764 B1 7/2003 Dean
6,754,919 B2 6/2004 Leaphart, Jr. et al.
6,986,928 B2 1/2006 Almansa Perea
7,757,614 B2 7/2010 Nurse-Bey
8,166,893 B2 * 5/2012 Davis ..... A47B 13/16 108/26
8,196,528 B2 6/2012 Jones
8,807,503 B2 8/2014 Zavala, Jr.
2002/0062766 A1 * 5/2002 Badaracco ..... A47G 11/003 108/90
2002/0172797 A1 * 11/2002 Sugawara ..... A47G 11/006 428/99
2002/0174809 A1 * 11/2002 Kerrigan ..... A47G 11/003 108/90
2003/0015270 A1 1/2003 McClenahan et al.
2003/0200589 A1 10/2003 Therres
2007/0020428 A1 1/2007 Hernandez
2008/0000399 A1 * 1/2008 Herbert ..... A47F 3/005 108/90
2010/0139531 A1 * 6/2010 Valeriote ..... A47B 13/003 108/90
2012/0097078 A1 4/2012 Schwabe et al.
2012/0180705 A1 * 7/2012 Hafner ..... A47B 37/00 108/50.13
2014/0349039 A1 * 11/2014 Finell ..... A47G 11/006 428/33
2017/0156527 A1 * 6/2017 Vara ..... A47G 23/0241

* cited by examiner

PLACE SETTING OVERLAY FOR A TABLE

CROSS-REFERENCE TO RELATED APPLICATIONS

This application claims the benefit of U.S. Provisional Patent Application 62/476,376, filed on Mar. 24, 2017, and incorporated herein by reference.

STATEMENT REGARDING FEDERALLY SPONSORED RESEARCH AND DEVELOPMENT

Not Applicable.

FIELD OF THE INVENTION

This invention relates to tools of efficacy in establishing and enhancing placement of guests equidistance about a table perimeter.

DISCUSSION OF RELATED ART

Dining tables are typically a single color of wood or other material, and place settings around the table typically include one or more plates, silverware, glassware and sometimes a bowl or other items. Prior art teaches decorative and protective solutions for tables of small gatherings of diners utilizing textiles that combine separate strips of pieces to form an unattached assembly. This type of prior art system, while creating a place setting and providing a visual function for small groups who know where to sit without guidance or direction, fails to provide an effective tool within the industry of larger gatherings wherein dozens or hundreds or even thousands of attendees require the setting of many tables at once. Place mats are used to define an area for a place setting and the position of diners or guests around the table, and often the place mats have a color contrasting the color of the table, which provides some additional visual variety and a certain aesthetic look. With larger gatherings in substantial spaces, it becomes more difficult to equally space place settings around the table, particularly with long rectangular tables or a multitude of large circular tables. As such, it can be time consuming and thus costly to quickly put all of the place settings down in a balanced arrangement on the table yet maximizing the comfort to guests. Further, with larger tables the color of the table can be overly dominating visually.

Therefore, there is a need for a system that provides quick guidance for those creating a truly equal spacing of the place settings around the table. Further, such a needed invention would provide colorful décor for helping the visual impact of the table and place settings, including the promotion of sponsors, hosts, causes or themes and breaking-up the often monotonous table color. Such a needed system when produced in reusable textiles or recyclable disposable options such as paper and plastics could be relatively inexpensive to manufacture and provide a low cost visual enhancement to busy hosts. The needed invention would optionally allow for thermal pads for heating or cooling certain of the dishes at each place setting, and would provide means for adding LEDs and other adornments without wires being visible. The present invention accomplishes these objectives.

SUMMARY OF THE INVENTION

The present device is an overlay system for a table having a center area and a perimeter. The table is for receiving a plurality of place settings for a plurality of guests. The overlay is for quickly and evenly placing a plurality of guests about the perimeter of a table. With either circular, rectangular, hexagonal, or octagonal tables, the overlay system provides a means by which people and dining objects are equally spaced about the table, and by which colorful décor may be applied to the table for adding aesthetic appeal to the dining experience.

The overlay system comprises, in a first simple embodiment, a plurality of flexible elongated arms each having a distal end and a proximal end. A connector is fixed proximate the proximal end of each arm and adapted to connect to the connector of an adjacent arm.

In use, with the arms each mutually connected at their proximal ends, and the proximal ends positions proximate the center area of the table, a regular geometric shape is formed in the center area of the table and the arms extend mutually equidistantly about the table to define a seating area for each place setting and guest. Preferably, in the case of a circular table, the plurality of arms are mutually connected at an angle such that the plurality of arms are equally distributed about the table. Similarly, the distal end of each arm can include an adornment connector, such that an adornment may be fixed with the adornment connector to provide for a different, enhanced appearance.

Some embodiments include a pocket on each arm. A temperature-adjustment implement, such as an electric or chemical hot pad, or an ice-pad, may be inserted into the pocket to keep a dish of the place setting warm or cold, for example. A decorative cover may be included to cover at least a portion of the center area of the table, whereby power cords are concealed by the cover. Power cords may also be included with LEDs or other electronic devices, such power cords being concealed below the arms and/or cover.

Some embodiments of the invention include a central section that has a plurality of the connectors. In such embodiments, the arms are not necessarily connected with each other at the connectors, but rather can be connected only to or also to one of the connectors of the central section. Such a central section may be positioned under the proximal ends of each arm and adapted to form a chevron-type geometric shape in the center area of the table. As such, the central section is not visible during use.

Alternately, the central section may include a plurality of décor connectors adapted for fixing with décor elements, such as paper or textile flowers, other decorative elements, or the like. Such décor connectors may traverse a connector aperture in the central section, such that the décor elements conceal the décor connectors.

In a simple embodiment having the central section, each arm is fixed with the central section at a dot of hook-and-loop fastening material, or a mechanical snap, or alternative connector. Alternately the central section may be ring containing notches or holes disbursed equidistant about the ring's perimeter from which elongated arms extend, either up to the perimeter of the table or past the perimeter of the table to hang down at the side of the table. The arms may be integrally formed with the central section such that the overlay system is effectively a single piece of flexible material.

The present invention is a system that provides a template for equal spacing of the place settings around the table, resulting in efficiently establishing a pleasing and balanced appearance and a comfortable dining experience for all guests. Further, the present invention provides colorful décor for helping the visual impact of the table and place settings, and is fast and easy to place on the table, wash and store. The present system may be cleaned and stored for reuse, shared over-time by multiple hosts or manufactured from inexpensive disposable materials—all options resulting in a low cost tool to event hosts. LEDs and other adornments can be optionally included without wires being visible. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1A:
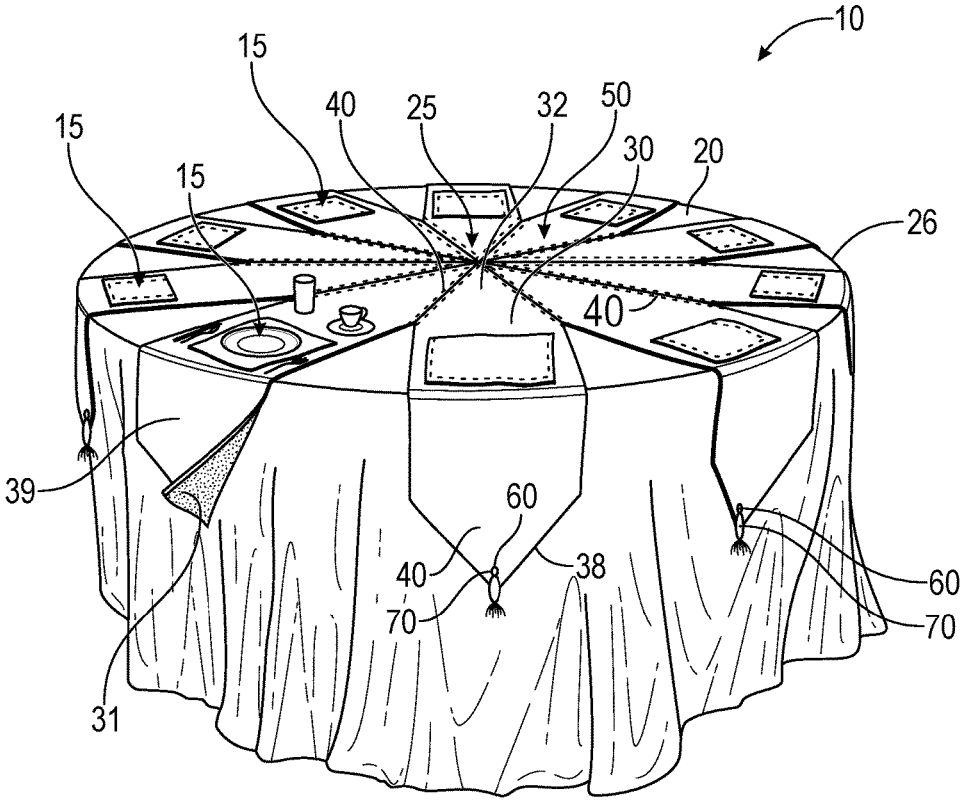
FIG. 1A is a perspective view of a first embodiment of the invention.
Figure 1B:
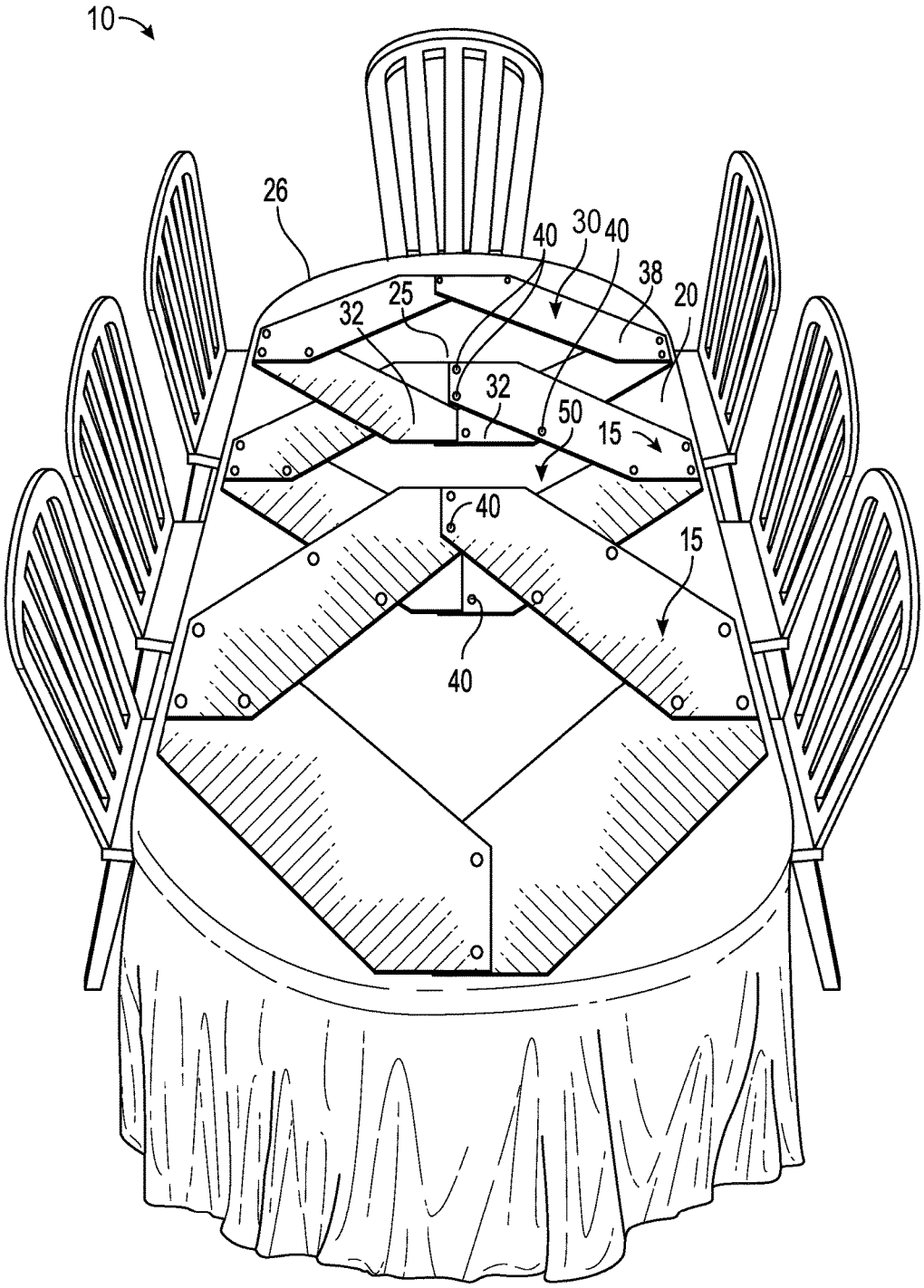
FIG. 1B is a perspective view of a second embodiment of the invention.

FIGS. 1 and 2 illustrate an overlay system 10 for a table 20 having a center area 25 and a perimeter 26. The table 20 is for receiving a plurality of place settings 15 for a plurality of guests (not shown). With either circular, rectangular, hexagonal, or octagonal tables, the overlay system 10 provides a means by which the place settings 15 are equally spaced about the table 20, and by which colorful décor may be applied to the table for adding aesthetic appeal to the dining experience.

The overlay system 10 comprises, in a first simple embodiment, a plurality of flexible elongated arms 30 each having a distal end 38 and a proximal end 32. Each arm 30 may be made from a relatively flat fabric sheet material, yarn or other string, paper, vinyl sheet material, ribbons, or other flexible, malleable, plastic, linked glass, rubber, mirrors, linked woods, mesh, foils and metals, or resilient materials.

Figure 3:
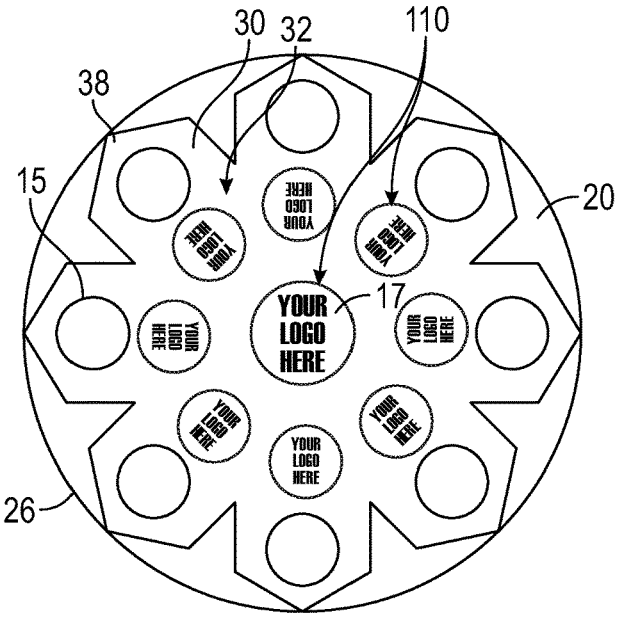
FIG. 3 is a top plan view of a fourth embodiment of the invention.

A connector 40 is fixed proximate the proximal end 32 of each arm 40 and adapted to connect to the connector 40 of an adjacent arm 30. Such a connector 40 can be, thread used to stitch each arm 30 to the adjacent arm 30 via seaming, hook-and-loop type fastening material, double-sided tape, mechanical fasteners such as snaps, zippers, clips, rivets, buttons, carabiners, or the like. Each arm 30 may include visually appealing shapes, designs, patterns or surface treatments or textures including an indicia area 110 to which indicia 18, such as a graphic logo or seal, may be applied (FIG. 3).

In use, with the arms 30 each mutually connected at their proximal ends 32, and the proximal ends 32 positions proximate the center area 25 of the table 20, a geometric shape 50 is formed in the center area 25 of the table 20 and the arms 30 extend mutually equidistantly about the table 20 to define a placement area for each place setting 15 of dishes and accoutrements, and mark a placement for the seat of each guest.

Preferably, in the case of a circular table (FIGS. 1 and 2A, for example), the plurality of arms 30 are mutually connected at an angle A such that the plurality of arms are equally distributed about the table 20. That is, if there are eight arms 30 for example, each arm 30 would be angled with respect to its adjacent arms 30 by an angle of 360-degress divided by 8, or 45-degrees.

In some embodiments, each arm 30 includes a top side 39 and a bottom side 31 (FIG. 1A), the top side 39 visually contrasting with the bottom side 31, such that the arms 30 are reversible on the table for providing a different appearance. Similarly, the distal end 38 of each arm 30 can include an adornment connector 60, such that an adornment 70 may be fixed with the adornment connector 60 to provide for a different, enhanced appearance. Such an adornment connector 60 may be a loop with a snap (not shown), an aperture through which a clip may be fastened, a wire ring (not shown), or the like. Such an adornment 70 may be a tassel, beaded string (not shown), metallic charm (not shown), or the like.

Figure 2A:
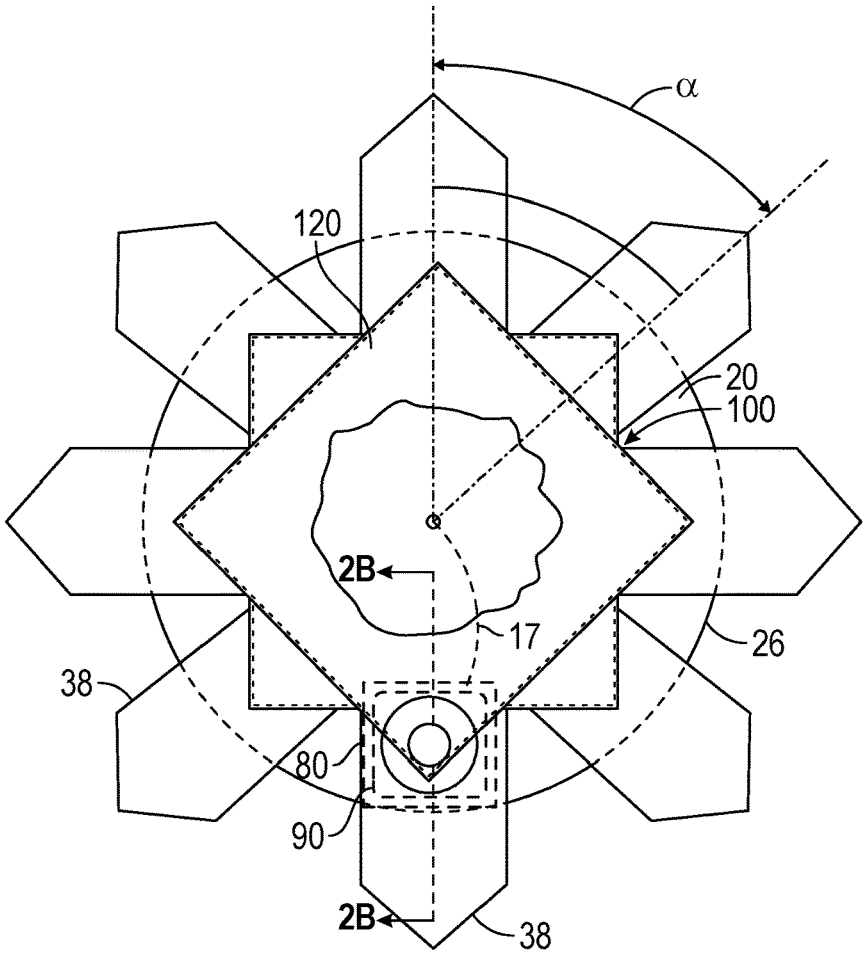
FIG. 2A is a top plan view of a third embodiment of the invention.
Figure 2B:
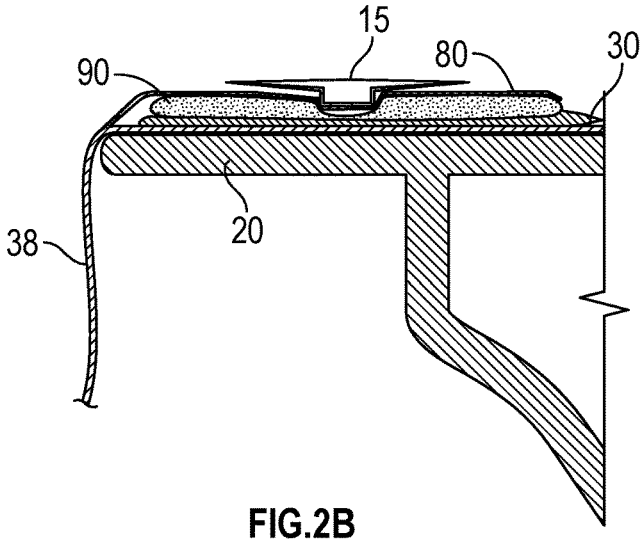
FIG. 2B is a partial cross-sectional view of the third embodiment, taken alone lines 2B-2B of FIG. 2A.
Figure 4:
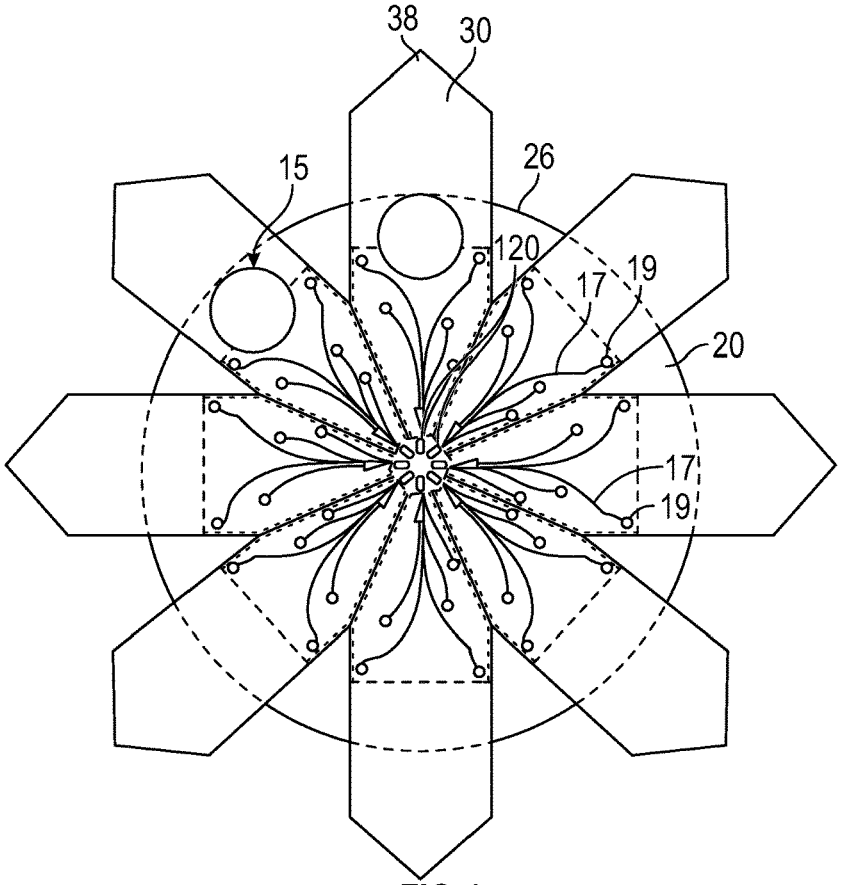
FIG. 4 is a top plan view of a fifth embodiment of the invention.
Figure 5:
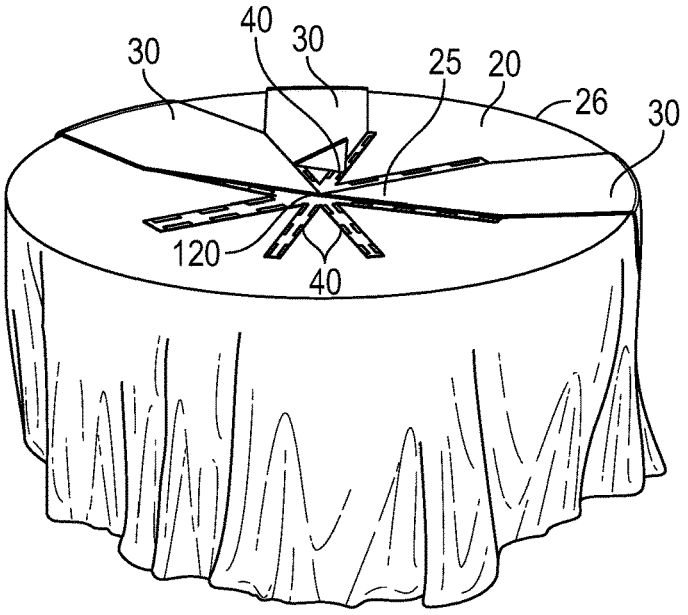
FIG. 5 is a perspective view of a sixth embodiment of the invention.

Some embodiments, such as illustrated in FIGS. 2A and 2B, include a pocket 80 on each arm 30. A temperature-adjustment implement 90, such as an electric or chemical hot pad 90, or an ice-pad (not shown), may be inserted into the pocket 80 to keep a dish of the place setting 15 warm or cold, for example. Ice cream in a bowl might be best served on a dish 15 having a cold-pad 90 below it in such a pocket 80. Soup, on the other hand, might be best served in a dish on a previously-placed exothermic heat source (no cord required) or electric heating source 90. A decorative cover 100 may be included to cover at least a portion of the center area 25 of the table 20, whereby power cords 17 are concealed by the cover 100. Power cords 17 may also be included with LEDs 19 (FIG. 4) or other electronic devices, such power cords 17 being concealed below the arms 30 and/or cover 100. Alternately, chemiluminescent decorations (not shown) may be attached to the arms 30.

Figure 9:
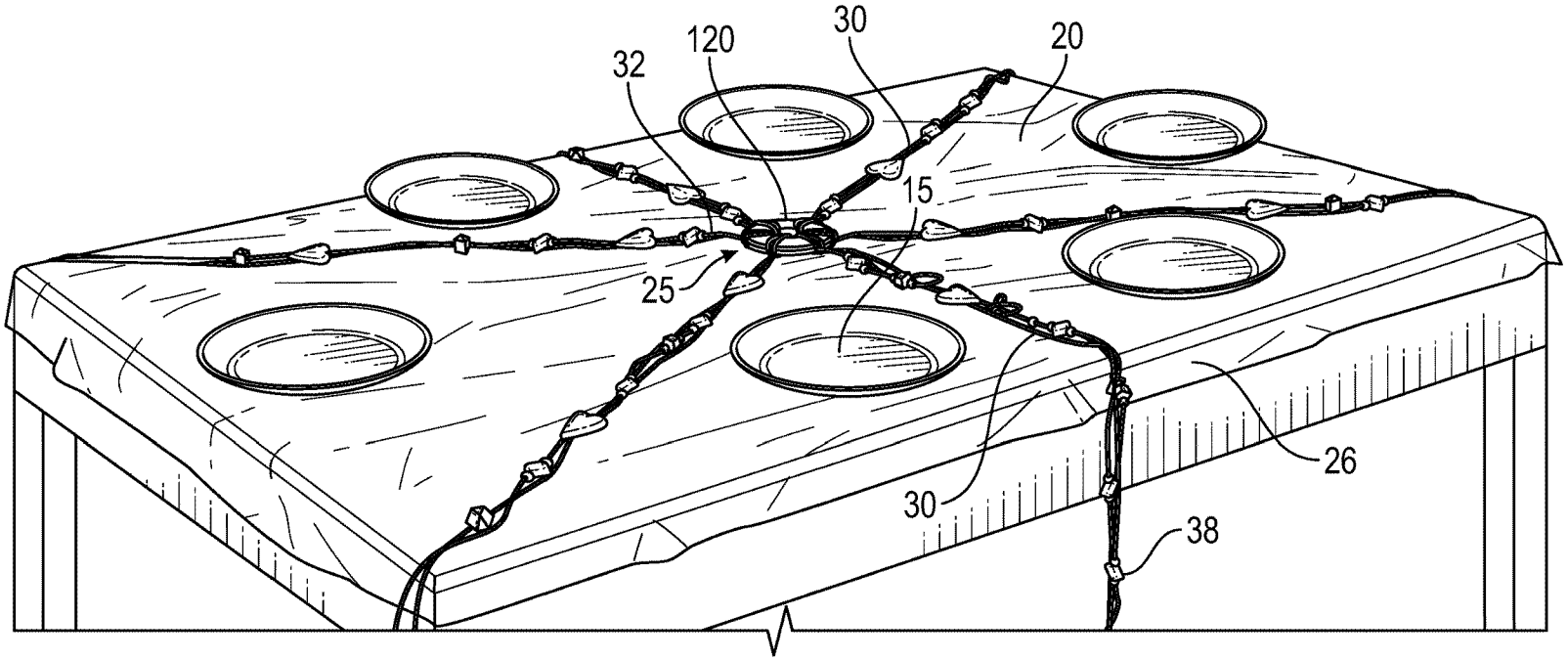
FIG. 9 is a perspective view of a tenth embodiment.

Some embodiments of the invention include a central section 120 that has a plurality of the connectors 40 (FIGS. 5-9). In such embodiments, the arms 30 are not necessarily connected with each other at the connectors 40, but rather can be connected only to or also to one of the connectors 40 of the central section 120. Such a central section 120 may be positioned under the proximal ends 32 of each arm 30 (FIG. 5) and adapted to form a chevron-type geometric shape 50 in the center area 25 of the table 20. The central section 120 may not always be visible during use. The central section 120 when not visible, may be made from a variety of flat materials such as stiff paper card stock, plastic, vinyl, flexible fabric, metal or other rigid materials. When visible the central section 120 may include metal, paper, rubber, wood, plastic or other decorative materials that compose a ring with geometric markings for negative space placements of materials such as the place settings 15. The central section 120 may be made with a flexible fabric or vinyl material, or a resilient material, or a rigid material such as a metal ring (FIG. 9).

Figure 6A:
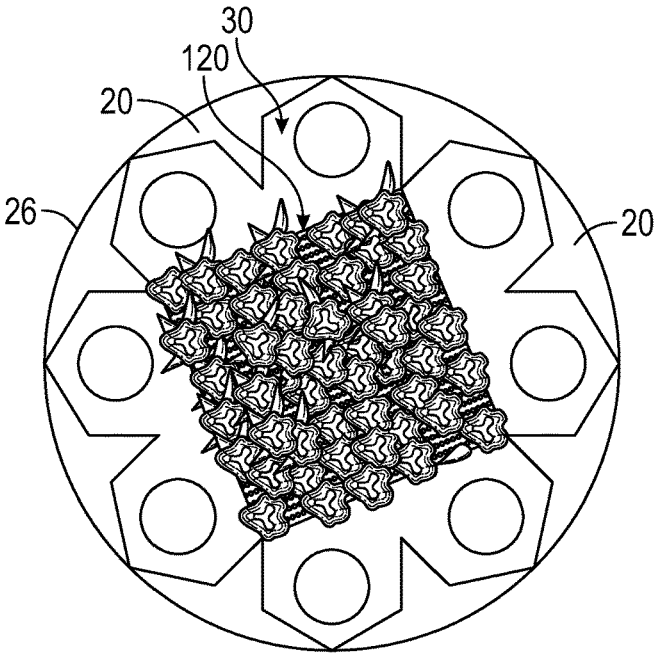
FIG. 6A is a top plan view of a seventh embodiment of the invention.
Figure 6C:
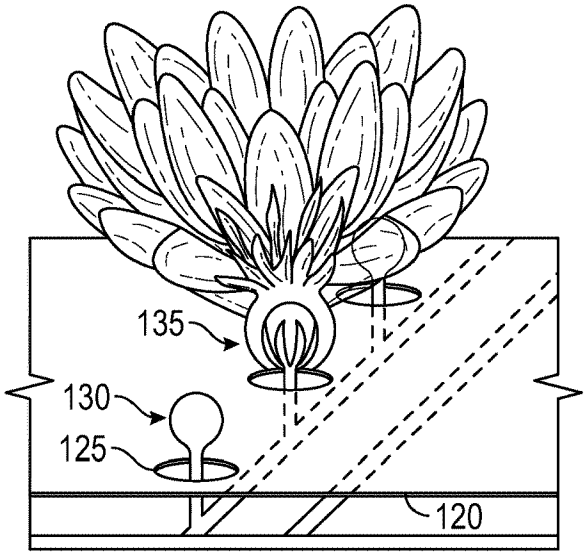
FIG. 6C is a partial enlarged perspective view of the central section of the seventh embodiment.
Figure 6B:
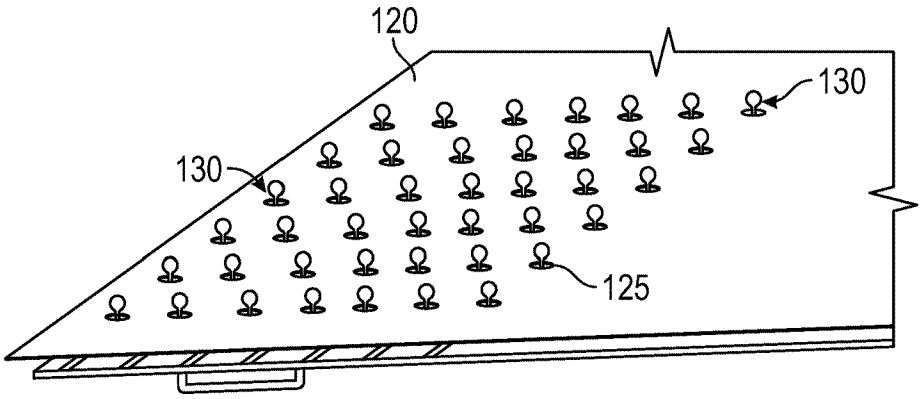
FIG. 6B is a partial perspective view of a central section of the seventh embodiment.
Figure 7:
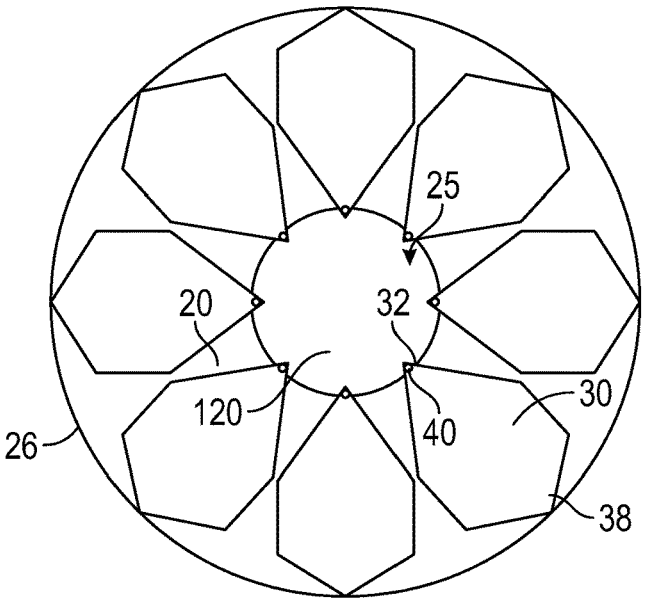
FIG. 7 is a top plan view of an eighth embodiment.
Figure 8:
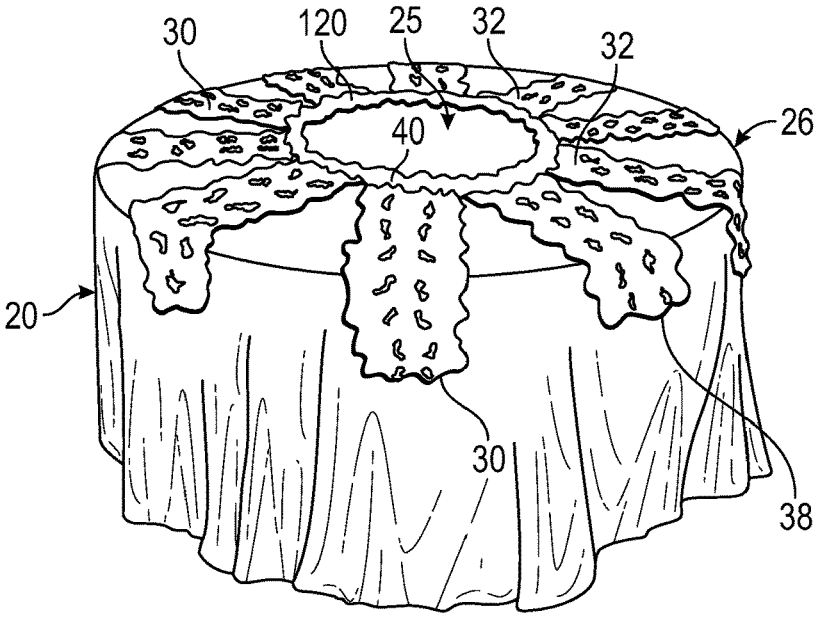
FIG. 8 is a perspective view of a ninth embodiment.

Alternately, the central section 120 may include a plurality of décor connectors 130 adapted for fixing with décor elements 135, such as paper or fabric flowers or other decorative objects and the like (FIGS. 6A-6C). Such décor connectors 130 may traverse a connector aperture 125 in the central section 120, such that the décor elements 135 conceal the décor connectors 130.

In a simple embodiment having the central section 120, each arm 30 is fixed with the central section 120 at a hook-and-loop dot, mechanical snap or rivet connector 40 (FIG. 7), and may be quickly changed, added, laundered, or reversed to an alternate side or color. Alternately the central section 120 may be a ring (FIG. 8) from which elongated arms 30 extend, either up to the perimeter 26 of the table 20 or past the perimeter 26 of the table 20 to hang down at the side of the table 20 and establish place settings 15 and demarcate negative space within which dining accoutrements are evenly placed between the arms 30 rather than upon the arms 30 as in other embodiments. The arms 30 may be a woven fabric material, strings of yarn (FIG. 9) wherein the connector 40 is a knot in the yarn, crocheted material, vinyl plastic material, or other flexible materials that are preferably easily washed and folded or stacked.

The arms 30 may be integrally formed with the central section 120 such that the overlay system 10 is effectively a single piece of flexible material (FIG. 3).

While a particular form of the invention has been illustrated and described, it will be apparent that various modifications can be made without departing from the spirit and scope of the invention. For example, various materials not shown in the drawings for both the arms 30 and the central section 120 may be utilized, either as is currently known or becomes known in the future. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. An overlay system for a table having a center area and a perimeter, the table for receiving a plurality of place settings, the overlay system comprising:

a plurality of flexible arms each having a distal end and a proximal end; and a plurality of connectors each connecting two adjacent flexible arms together proximate their proximal ends;

whereby with the arms each mutually connected at their proximal ends, and the proximal ends positioned proximate the center area of the table, a geometric shape is formed in the center area of the table and the arms extend equidistant about the table to define a seating area for each place setting.

2. The overlay system of claim 1 wherein with a circular table the plurality of arms mutually connect at an angle such that the plurality of arms are equally distributed about the table.

3. The overlay system of claim 1 wherein each arm connects to an adjacent arm at an angle of 360-degrees divided by the number of arms.

4. The overlay system of claim 1 wherein each arm includes a top side and a bottom side, the top side contrasting with the bottom side, whereby the arms are reversible.

5. The overlay system of claim 1 wherein the distal end of each arm includes an adornment attached thereto and by an adornment connector.

6. The overlay system of claim 1 wherein each arm includes a temperature-adjustment implement inserted into a pocket on said arm to heat or cool an object placed in contact thereupon.

7. The overlay system of claim 1 further including a decorative cover adapted to cover at least a portion of the center area while concealing power cords traversing said portion.

8. The overlay system of claim 1 wherein each arm includes an indicia area, to which an indicia or logo is applied.

9. An overlay system for a table having a center area and a perimeter, the table for receiving a plurality of place settings, the overlay system comprising:

a central section including a plurality of décor connectors adapted for attaching décor elements to the central section;

a plurality of flexible arms each having a distal end and a proximal end; and a plurality of connectors each connecting one of the flexible arms to the central section;

whereby with the arms each mutually connected at their proximal ends by means of the central section, and the proximal ends positioned proximate the center area of the table, a geometric shape is formed in the center area of the table and the arms extend equidistant about the table to define a seating area for each place setting.

10. The overlay system of claim 9 wherein each décor connector traverses a connector aperture in the central section to be hidden from view within said aperture by the attached décor element.

11. The overlay system of claim 9 wherein each arm includes a top side and a bottom side, the top side contrasting with the bottom side, whereby the arms are reversible.

12. The overlay system of claim 9 further including a decorative cover adapted to cover at least a portion of the central section, whereby power cords are concealed by the cover.

13. The overlay system of claim 9 wherein each arm includes an indicia area, to which an indicia or logo is applied.

14. The overlay system of claim 9 wherein the central section includes an indicia area, to which an indicia or logo is applied.

15. An overlay system for a table having a center area and a perimeter, the table for receiving a plurality of place settings, the overlay system comprising:

a central section;

a plurality of flexible arms each having a distal end and a proximal end;

wherein the distal end of each arm includes an adornment attached thereto by an adornment connector; and a plurality of connectors each connecting one of the flexible arms to the central section;

whereby with the arms each mutually connected at their proximal ends by means of the central section, and the proximal ends positioned proximate the center area of the table, a geometric shape is formed in the center area of the table and the arms extend equidistant about the table to define a seating area for each place setting.

16. The overlay system of claim 15 wherein each arm includes a top side and a bottom side, the top side contrasting with the bottom side, whereby the arms are reversible.

17. The overlay system of claim 15 further including a decorative cover adapted to cover at least a portion of the central section, whereby power cords are concealed by the cover.

18. The overlay system of claim 15 wherein each arm includes an indicia area, to which an indicia or logo is applied.

19. The overlay system of claim 15 wherein the central section includes an indicia area, to which an indicia or logo is applied.

20. An overlay system for a table having a center area and a perimeter, the table for receiving a plurality of place settings, the overlay system comprising:

a central section;

a plurality of flexible arms each having a distal end and a proximal end;

wherein each arm includes a temperature-adjustment inserted into a pocket on said arm to heat or cool an object placed in contact thereupon; and a plurality of connectors each connecting one of the flexible arms to the central section;

whereby with the arms each mutually connected at their proximal ends by means of the central section, and the proximal ends positioned proximate the center area of the table, a geometric shape is formed in the center area of the table and the arms extend equidistant about the table to define a seating area for each place setting.

21. The overlay system of claim 20 wherein each arm includes a top side and a bottom side, the top side contrasting with the bottom side, whereby the arms are reversible.

22. The overlay system of claim 20 further including a decorative cover adapted to cover at least a portion of the central section, whereby power cords are concealed by the cover.

23. The overlay system of claim 20 wherein each arm includes an indicia area, to which an indicia or logo is applied.

24. The overlay system of claim 20 wherein the central section includes an indicia area, to which an indicia or logo is applied.

25. An overlay system for a table having a center area and a perimeter, the table for receiving a plurality of place settings, the overlay system comprising:

a plurality of yieldingly flexible arms each having a distal end and a proximal end, the distal end extending over the perimeter of the table and dropping freely therefrom; and a plurality of connectors each connecting two adjacent flexible arms together proximate their proximal ends;

whereby with the arms each mutually connected at their proximal ends, and the proximal ends positioned proximate the center area of the table, a geometric shape is formed in the center area of the table and the arms extend equidistant about the table to define a seating area for each place setting.

* * * * *